US005604963A

United States Patent [19]

Akeno

[11] Patent Number: 5,604,963

[45] Date of Patent: Feb. 25, 1997

[54] HOOK STRUCTURE FOR MOLDED SURFACE FASTENER

[75] Inventor: Mitsuru Akeno, Toyama-ken, Japan

[73] Assignee: YKK Corporation, Tokyo, Japan

[21] Appl. No.: 546,938

[22] Filed: Oct. 23, 1995

[30] Foreign Application Priority Data

Oct. 24, 1994 [JP] Japan ..... 6-258153

[51] Int. Cl.[6] ..... A44B 18/00

[52] U.S. Cl. ..... 24/452; 24/442; 24/449; 428/100

[58] Field of Search ..... 24/452, 442, 446, 24/447, 448, 449, 450, 451; 428/100

[56] References Cited

U.S. PATENT DOCUMENTS

| | | | |
|---|---|---|---|
| 3,708,833 | 1/1973 | Ribich et al. | 24/450 |
| 3,762,000 | 10/1973 | Menzin et al. | 24/452 |
| 4,984,339 | 1/1991 | Provost et al. | 24/452 |
| 5,131,119 | 7/1992 | Murasaki et al. | 24/452 |
| 5,315,740 | 5/1994 | Provost | 24/452 |

*Primary Examiner*—Peter R. Brown
*Assistant Examiner*—Hank V. Tran
*Attorney, Agent, or Firm*—Hill, Steadman & Simpson

[57] ABSTRACT

In a hook structure for a molded surface fastener, in an arbitrary cross section of each of a stem and a hook-shape engaging portion of a hook, the cross-sectional area is divided into front and rear side cross-sectional areas with respect to the center line of the hook, and the front side cross-sectional area is defined to be larger than the rear side cross-sectional area. Therefore, the neutral plane of the hook is shifted toward the front side of the stem and the inner side of the hook-shape engaging portion to a further extent than conventional to reduce possible tensile stresses in the front part of the stem and the inner part of the hook-shape engaging portion so that, as compared to the conventional hook made of the same resin quantity and having a substantially similar shape, the strength of the hook is increased sharply and, necessarily, both the front part of the stem and the inner part of the hook-shape engaging portion is increased in rigidity as compared to the other part and hence is difficult to deform, thus causing an increased strength as well as an increased engaging strength with a loop of a companion surface fastener.

19 Claims, 7 Drawing Sheets

HOOK STRUCTURE FOR MOLDED SURFACE FASTENER

BACKGROUND OF THE INVENTION

1. Field of the Invention

This invention relates to a molded surface fastener in which a multiplicity of hooks are molded on a substrate sheet by extrusion or injection molding of thermoplastic synthetic resin, and more particularly to a hook structure in which hooks to be molded of the same quantity of resin are improved in engaging strength and durability.

2. Description of the Related Art

Surface fasteners of the type in which hooks are formed by weaving monofilaments in a woven cloth so as to form loop piles of monofilaments and then cutting the loop piles are well known in the art. This type surface fastener has softness of a woven cloth and softness of monofilament and is characterized in that the hooked surface fastener comes into engagement with and are peeled off loops of a companion surface fastener with a very smooth touch. Moreover, since the monofilaments constituting the hooks are treated by drawing, the surface fastener is excellent in pulling strength and bending strength even in a small cross-sectional area. Further, since the surface fastener can have a very high density of hooks depending on the woven structure, it is possible to secure a high engaging rate and an adequate degree of durability. However, with the woven type surface fastener, since consumption of material and a number of processing steps are large, it is difficult to reduce the cost of production.

For an improvement, a molded type surface fastener was developed in which a substrate sheet and hooks are formed integrally and simultaneously by extrusion or injection molding. Typical examples of molding technology for this type surface fastener are disclosed in, for example, U.K. Patent No. 1319511 and WO 87/06522. As a rotary drum in which a number of molding disks each having on an outer peripheral edge of each of opposite surfaces a number of hook-forming cavities and a number of spacer disks each having flat surfaces are alternately superimposed one over another is rotated, molten synthetic resin material is forced against its peripheral surface to fill the cavities and then the hooks formed in the cavities are removed off the drum along with the substrate sheet. The spacer disks are disposed between the molding disks because the cavities of the whole shape of the hooks cannot be made in one mold due to the shape of the hooks.

However, in the molded type surface fastener, partly since a delicate shape cannot be obtained as compared to the woven type surface fastener due to technical difficulty in molding process, and partly since the formed hooks are poor in orientation of molecules, only a very low degree of strength can be achieved with the same size of the above-mentioned monofilament hooks. Therefore none of the conventional molded type surface fasteners are satisfactory for practical use. Further, according to the conventional hook structure, the individual stem is simple in cross-sectional shape and would hence tend to fall flat from its base. As a result, the individual stems would not restore their original posture after repeated use, thus lowering the rate of engagement with loops of a companion surface fastener. Therefore, in order to secure desired strength, it is absolutely necessary to increase the size of the individual hooks, which makes the hooks rigid and the number of hooks per unit area (density of hooks) reduced to lower the rate of engagement with the companion loops.

As a solution, a new hook structure which enables a smooth touch, with the stem hardly falling flat, during the engaging and peeling operation likewise the woven type surface fastener and which increases the rate of engagement to secure adequate strength is disclosed in, for example, U.S. Pat. No. 5,131,119. In the molded type surface fastener disclosed in this U.S. Patent, each hook has a hook-shape engaging portion extending forwardly from the distal end of a stem which has a rear surface rising obliquely in a smooth curve from a substrate sheet and a front surface rising upwardly from the substrate sheet, and a reinforcing rib projecting from a side surface of the stem, the cross-sectional area of the hook increasing gradually from a tip of the hook-shape engaging portion toward the base of the stem. The reinforcing rib serves to prevent the stem from falling laterally and also to minimize the size of the stem and the hook-shape engaging portion, maintaining a required degree of engaging strength to the stem and the hook-shape engaging portion.

According to the conventional molded hook structure, it is totally silent about the transverse cross-sectional shape. Also in the above-mentioned prior art references, the respective molded hook structure has merely a triangular, a rectangular or a circular (including an oval) transverse cross-sectional shape. Therefore in the transverse cross-sectional shape taken along a plane perpendicular to the axis (center line) of the hook, the cross-sectional area is divided into front and rear cross-sectional areas with respect to the center line, and the rear side cross-sectional area is set to be equal to or larger than the front side cross-sectional area in either the stem or the hook-shape engaging portion. This means that the center of figure is located on the center line or the rear side of the hook.

When the molded hook is disengaged from the loop of the companion surface fastener, a tensile stress occurs inside the front part of the hook with respect to its neutral line while a compressive stress occurs inside the rear part of the hook. In general, this type hook of synthetic resin is resistant against a compressive stress but is remarkably less resistant to a tensile stress compared to a hook of rigid material. Accordingly, in the case of the conventional cross-sectional shape, small hooks in particular are not only too low in strength but also high in flexibility, so that the force of engagement with loops is remarkably lowered. When hooks having large transverse cross-sectional area are disengaged from loops, they would tend to be broken or damaged as the tensile stress in the front part of the hook increases according to the magnitude of the engaging force.

SUMMARY OF THE INVENTION

It is therefore an object of this invention to provide a hook structure which can increase an engaging force compared to the conventional hook structure, regardless of the size of the hook, and can minimize a tensile stress which occurs inside the front part of the hook.

According to this invention, the above-mentioned problems can be solved by a hook structure for a molded surface fastener comprising a substrate sheet and a multiplicity of hooks molded on and projecting from one surface of the substrate sheet, wherein each of the hooks is composed of a stem, which has a rear surface rising obliquely in a smooth curve from the substrate sheet and a front surface rising upwardly from the substrate sheet, and a hook-shape engaging portion extending forwardly from a distal end of the stem. And in each of a transverse cross section of the stem of each hook along a line parallel to the surface of the substrate sheet and an arbitrary transverse cross section including a normal line at a lower surface of the hook-shape engaging portion, when the cross-sectional area is divided into front and rear side cross-sectional areas with respect to the center, the front cross-sectional area is larger than the rear side cross-sectional area.

The shape of-the above-mentioned cross sectional area can be determined appropriately, but preferably, each transverse cross section has a generally trapezoidal shape, a shape analogous to the longitudinal cross section of an egg, a generally U shape, a generally inverted T shape, a generally criss-cross shape, or a triangular shape. Each hook has a varying cross-sectional area gradually increasing from a tip of the hook-shape engaging portion to a base of the stem. Further, each hook may have a reinforcing rib on at least one side surface of the stem.

In operation, since the center line of figure is eccentrically located toward the front side of the stem and the inner side of the hook-shape engaging portion, the neutral plane of the hook is shifted from the center line of figure toward the front side of the stem and the inner side of the hook-shape engaging portion to reduce possible tensile stresses which occurs in the front part of the stem and the inner part of the hook-shape engaging portion so that, as compared to the conventional hook made of the same quantity of resin and having a substantially similar shape, the strength of the hook is increased remarkably, and necessarily the front part of the stem and the lower part of the hook-shape engaging portion are increased in rigidity to hardly deform compared to the other part, thus causing an increased force of engagement with loops of the companion surface fastener.

Assuming that the transverse cross section of the hook, which may have a different shape such as a generally U shape, a generally inverted T shape or a generally criss-cross shape, has, for example, a generally criss-cross shape, the strength of hook is increased and, at the same time, the front part of the stem and the inner part of the hook-shape engaging portion is increased in rigidity compared to the other part, thus causing an increased force of engagement with loops of the companion surface fastener. Further, when the loop is disengaged from the hook as pulled in a stretching direction, the loop moves toward the tip of the hook-shape engaging portion as the hook-shape engaging portion progressively stands up. During that time, the loop frictionally presses opposite projections of the criss-cross section of the hook to deform against their resiliency as the loop gradually moves toward the tip of the hook. During this moving, the resilience and frictional force of the opposite ends of the widened part and the opposite ends of the criss-cross section are exerted on the loop so that the loop will become difficult to disengage from the hook, thus causing an increased force of engagement with the loop.

DETAILED DESCRIPTION OF PREFERRED EMBODIMENTS

Figure 1:
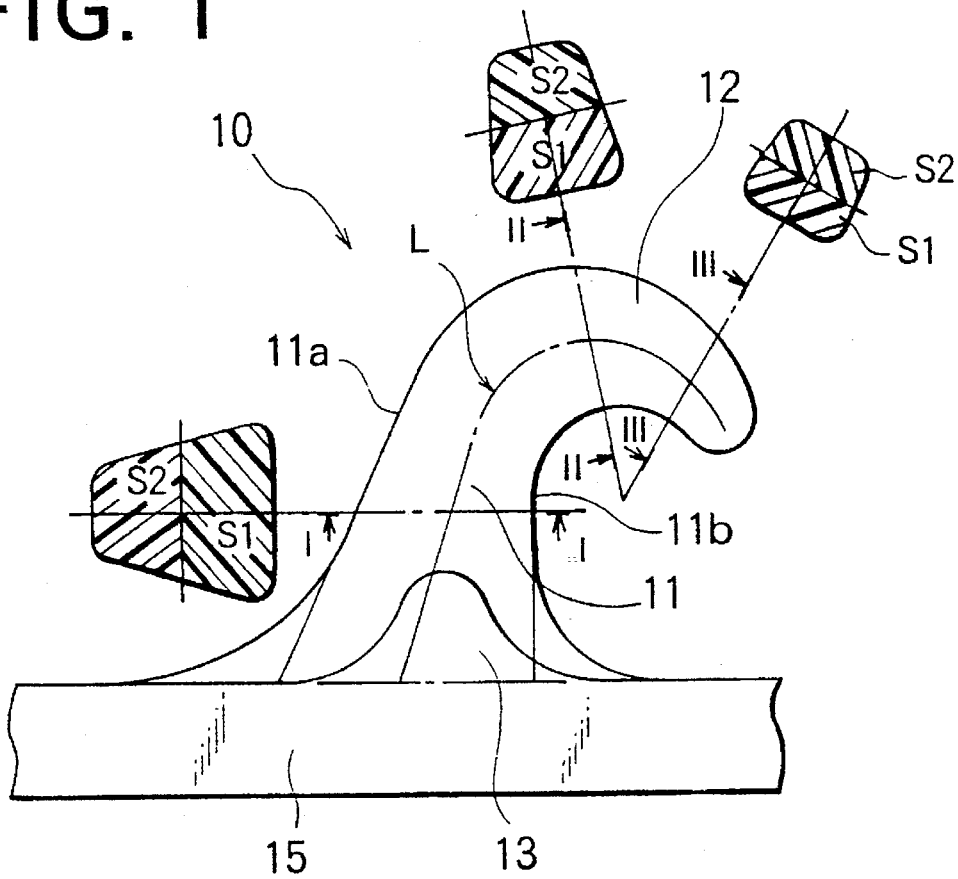
FIG. 1 is a side view of a hook according to a typical embodiment of this invention, with transverse cross-sectional views taken along lines I—I, II—II and III—III, respectively.
Figure 2:
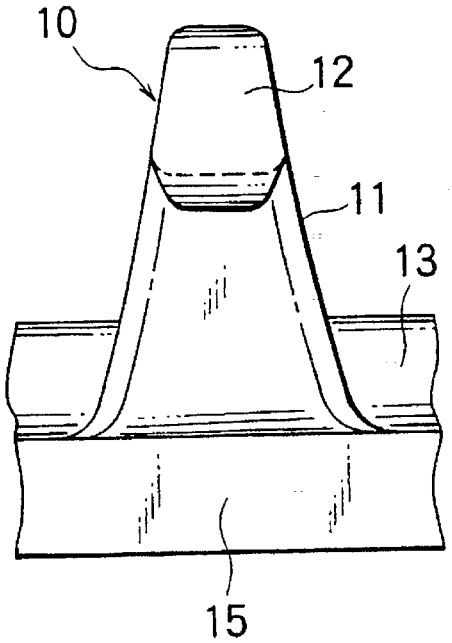
FIG. 2 a front view of the hook of FIG. 1.

Preferred embodiments of this invention will now be described in detail with reference to the accompanying drawings. FIG. 1 is a view showing a typical example of hook structure and variation of transverse cross sections according to this invention. FIG. 2 is a front view of the hook.

In FIGS. 1 and 2, a hook 10 has a stem 11, which has a rear surface 11*a* rising obliquely in a smooth curve from a substrate sheet 15 and a front surface 11*b* rising upwardly from the substrate sheet 15, and a hook-shape engaging portion 12 extending forwardly and curving downwardly from a distal end of the stem 11. The hook 10 has a varying transverse cross-sectional area progressively increasing from a tip of the hook-shape engaging portion 12 to a base of the stem 11. Further, in the illustrated example, the hook 10 has on each of opposite side surfaces a mount-shape reinforcing rib 13 extending from the base of the stem 11; but such reinforcing ribs 13 may be omitted. The reinforcing rib 13 may be a multi-step form so as to have a varying thickness larger toward the base, or may project upwardly beyond the upper end of the stem 11 and may terminate short of the upper end of the hook-shape engaging portion 12.

The characteristic feature of the hook 10 resides in the transverse cross-sectional shape of the stem 11 and the hook-shape engaging portion 12 in particular. Specifically, in each of a transverse cross section of the stem 11 parallel to the substrate sheet 15 and an arbitrary transverse cross section including a normal line at a lower surface of the hook-shape engaging portion 12, when the cross-sectional area is divided into front and rear side cross-sectional areas S1, S2 at the center line as viewed in side elevation, the front side cross-sectional area S1 is set to be larger than the rear side cross-sectional area S2. In this specification, the center line L of the hook 10 is a curve tracing successive center points of maximum width in either longitudinal or transverse width of every transverse cross section. Like reference designate similar parts or elements throughout various embodiments in the following description. In this invention, the cross-sectional profile of each of the stem 11 and the hook-shape engaging portion 12 may be arbitrarily decided. In the illustrated example, the front surface of the stem 11 gradually rises in a curve toward the rear side of the substrate sheet 15 and extends perpendicularly upwardly from the halfway. Alternatively, the front surface of the stem 11 may rise perpendicularly directly from the substrate sheet 15.

In the first embodiments of FIGS. 1 and 2, the transverse cross-sectional shape of each of the stem 11 and the hook-shape engaging portion 12 is generally trapezoidal. The top side of the trapezoidal shape defines the rear side of the stem 11 and the outer side of the hook-shape engaging portion 12, and the bottom side of the trapezoidal shape defines the front side of the stem 11 and the inner side of the hook-shape engaging portion 12, the entire transverse cross-sectional area increasing progressively from the-tip of the hook-shape engaging portion 12 to the base of the stem 11. Using this cross-sectional shape, the center line of figure of the hook 10 is located eccentrically toward the front side of the stem 11 and the inner side of the hook-shape engaging portion 12. As a result, the neutral surface of the hook 10 is shifted off the center line of figure to the front side of the stem 11 and the inner side of the hook-shape engaging portion 12 to reduce possible tensile stresses that occurs both in the front part of the stem 11 and the inner part of the hook-shape engaging portion 12 so that, as compared to the conventional hook made of the same resin quantity and having a substantially similar shape, the strength of the hook 10 is increased remarkably and, at the same time, since the front part of the stem 11 and the inner part of the hook-shape engaging portion 12 are increased in rigidity compared to the other part, and hence are difficult to deform thus causing an increased force of engagement with loops of the companion surface fastener.

Figure 3:
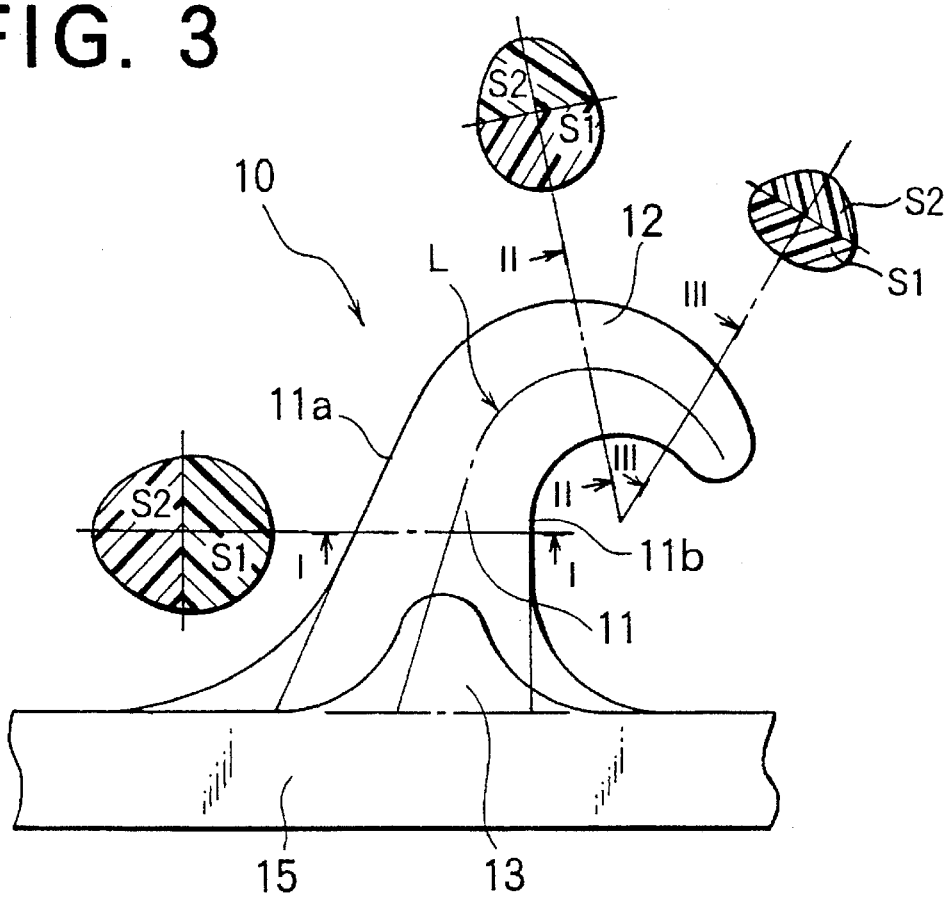
FIG. 3 side view of a hook according to a second embodiment of the invention, with transverse cross-sectional views taken along lines I—I, II—II and III—III, respectively.
Figure 4:
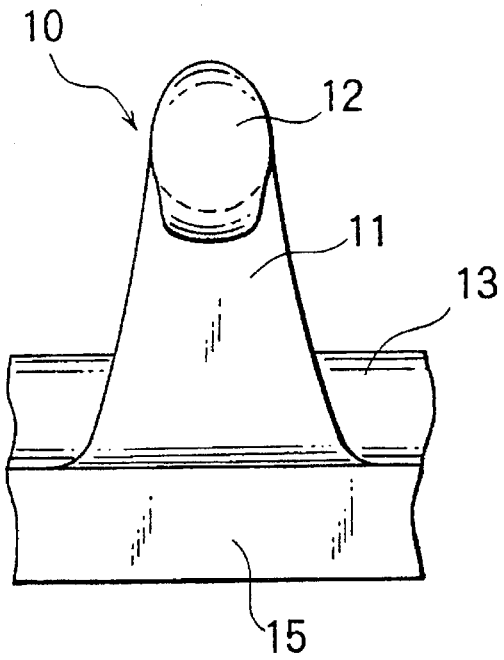
FIG. 4 is a front view of the hook of FIG. 3.
Figure 5:
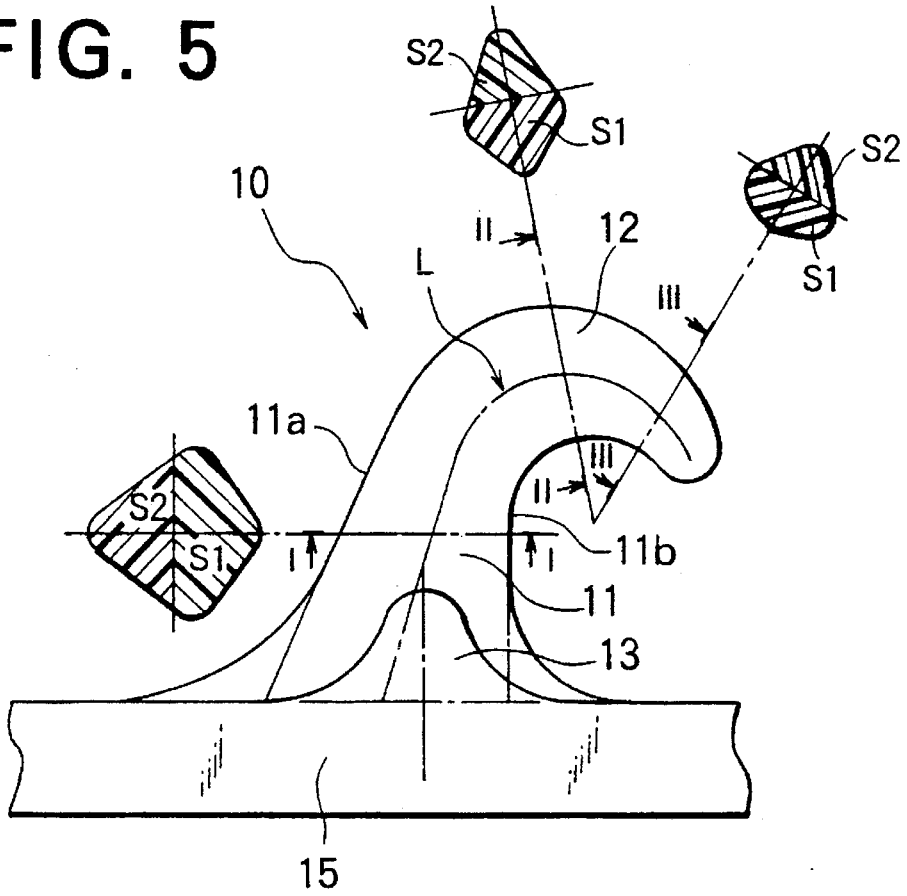
FIG. 5 is a side view of a hook according to a third embodiment of the invention, with transverse cross-sectional views taken along lines I—I, II—II and III—III, respectively.
Figure 6:
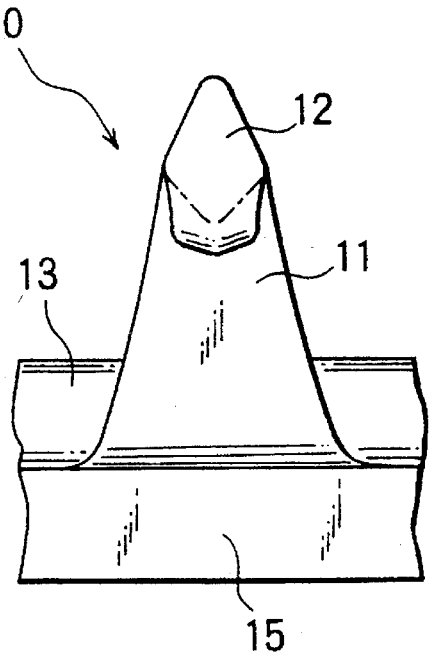
FIG. 6 is a front view of the hook of FIG, 5.

FIGS. 3 and 4 show a second embodiment of this invention, in which the transverse cross-sectional shape is analogous to a cross-sectional shape taken along the longitudinal axis of an egg. The small-width side of this eggshape cross section defines the rear side of the hook 10 while the large-width side of the egg-shape cross section defines the front side of the stem 11 and the inner side of the hook-shape engaging portion 12. FIGS. 5 and 6 show a third embodiment of this invention, in which the transverse cross-sectional shape of the hook 10 is a rhombic shape with two adjacent sides being shorter than the other two sides and located in the front side of the stem 11 and the inner side of the hook-shape engaging portion 12.

Figure 7:
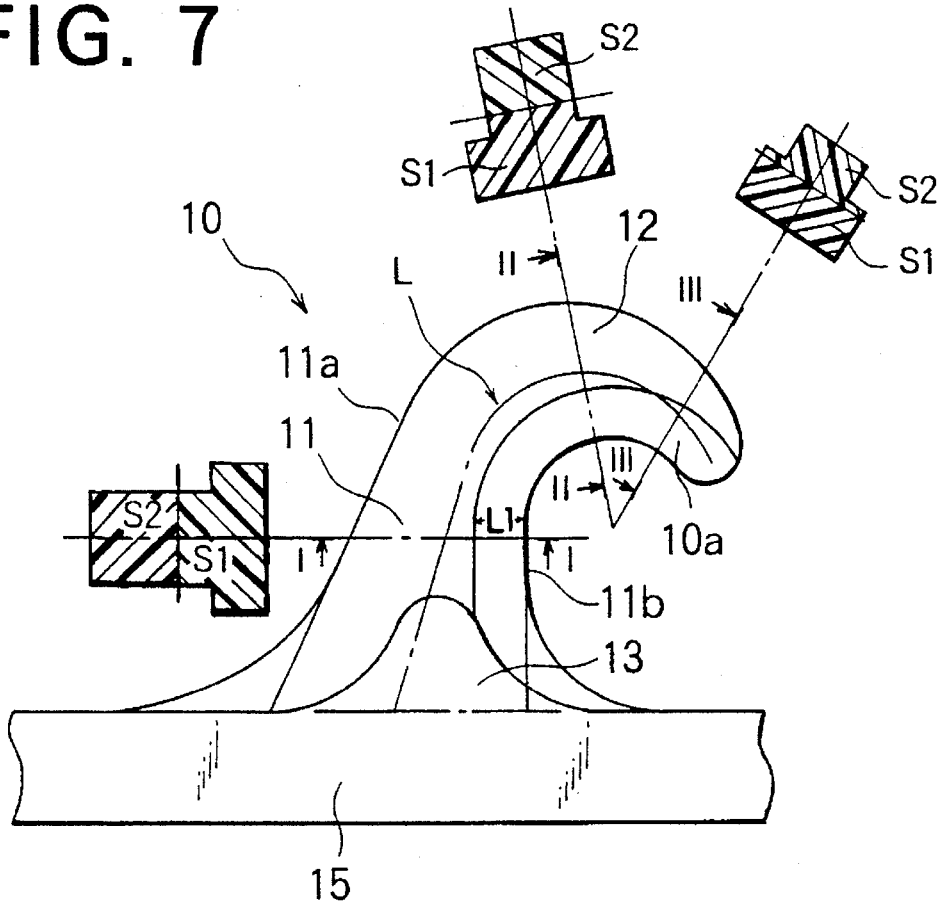
FIG. 7 is a side view of a hook according to a fourth embodiment of the invention, with transverse cross-sectional views taken along lines I—I, II—II and III—III, respectively.
Figure 8:
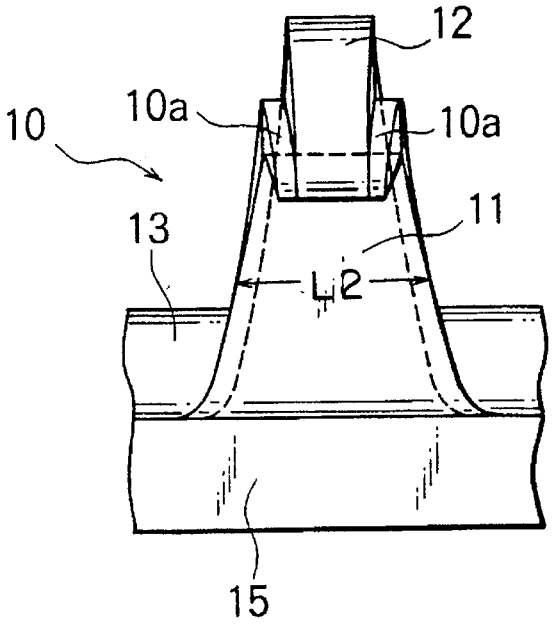
FIG. 8 is a front view of the hook of FIG. 7.

FIGS. 7 and 8 show a fourth embodiment of this invention, in which the transverse cross-sectional shape of the hook 10 is a generally inverted T shape with the large-width side located the front side of the stem 11 and the inner side of the hook-shape engaging portion 12. In this embodiment, the longitudinal (right and left direction of FIGS. 7) width L1 of the large-width part 10*a* is set to be the same along the entire length of the hook 10, and the thickness L2 of the large-width part 10*a* increases progressively from the tip to the base of the hook 10. Of course, The inverted T-shape cross section may increase analogously from the tip to the base of the hook 10. Alternatively, as shown in FIG. 9, the transverse cross-sectional shape may be a generally criss-cross shape with its opposite side projections 10*b* located eccentrically toward each of the front side of the stem 11 and the inner side of the hook-shape engaging portion 12.

Figure 9:
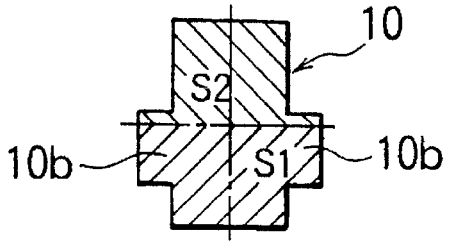
FIG. 9 is a transverse cross-sectional view showing a modification of the hook of FIG. 7.
Figure 10:
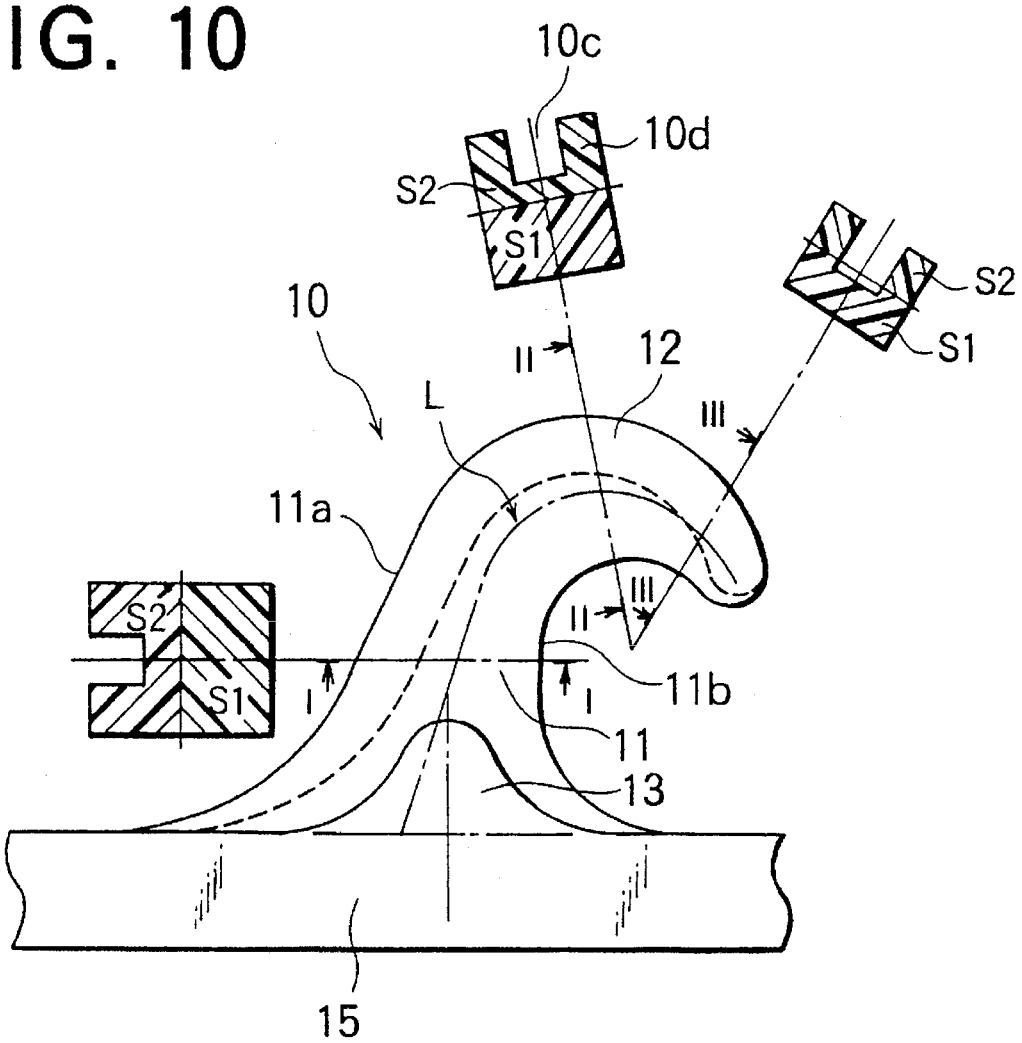
FIG. 10 is a side view of a hook according to a fifth embodiment of the invention, with transverse cross-sectional views taken along lines I—I, II—II and III—III, respectively.
Figure 11:
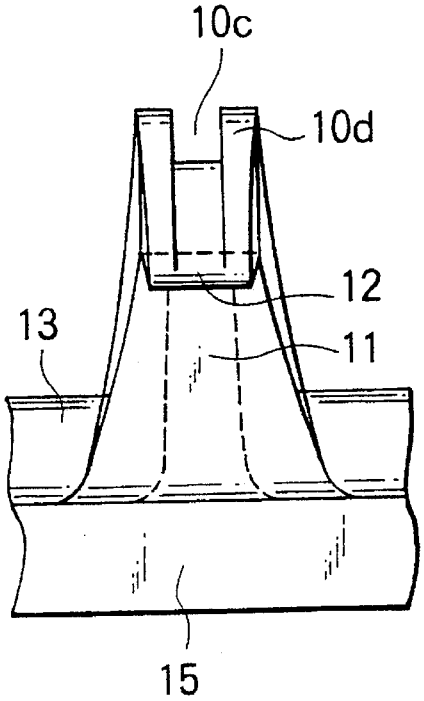
FIG. 11 is a front view of the hook of FIG. 10.
Figure 12:
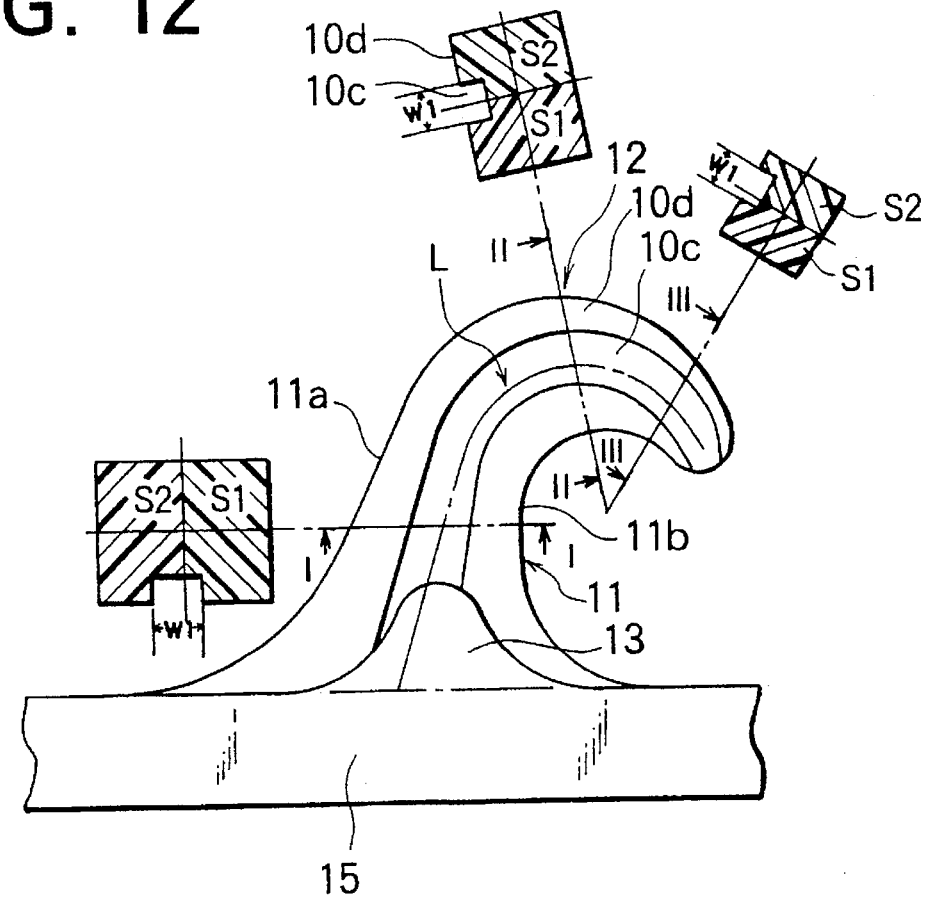
FIG. 12 is a side view of a hook according to a sixth embodiment of the invention, with transverse cross-sectional views taken along lines I—I, II—II and III—III, respectively.
Figure 13:
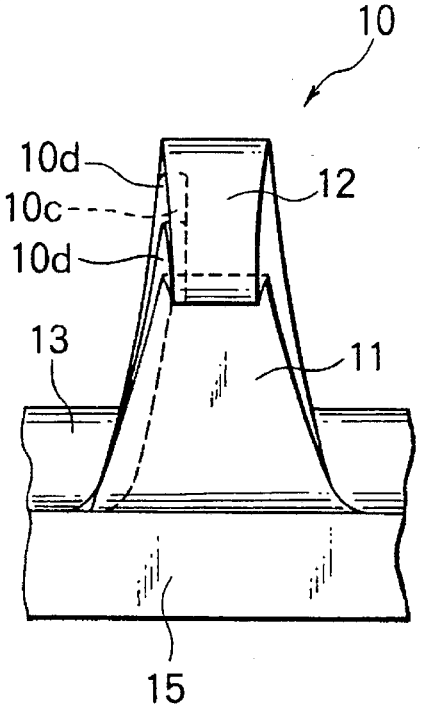
FIG. 13 is a front view of the hook of FIG. 12.

Also according to the fourth embodiment of FIGS. 7 through 9, the strength of the hook 10 increases remarkably likewise the first and second embodiments and, at the same time, each of the front part of the stem 11 and the inner part of the hook-shape engaging portion 12 has an increased degree of rigidness as compared to the other part, thus causing an increased force of engagement with a loop of the companion surface fastener. In the fourth embodiment, the force of engagement with the loop is further increased. Specifically, in this type surface fastener, when the loop is disengaged from the hook 10, the loop is pulled in a tensing direction and is moved toward the tip of the hook-shape engaging portion 12 as it causes the hook-shape engaging portion 12 of the hook 10 to progressively stand up. In the hook 10 of this embodiment, during this moving, the loop frictionally presses the opposite ends of the large-width part 10*a* or the opposite projections 10*b* of the criss-cross section to deform as it is moved progressively toward the tip of the hook 10. During this moving, the resilience and frictional force of the opposite ends of the widened part 10*a* and the opposite ends 10*b* of the criss-cross section are exerted on the loop so that the loop will become difficult to disengage from the hook 10, thus causing an increased force of engagement with the loop.

FIGS. 10 through 13 show fifth and sixth embodiments, in which the transverse cross section of the hook 10 has a U shape. In the fifth embodiment, a generally U-shape groove 10*c* is located in each of the rear part of the stem 11 and the outer part of the hook-shape engaging portion 12 and has a substantially uniform shape along the entire length of the hook 10. In the sixth embodiment, the U-shape groove 10*c* is located in one of the opposite side surfaces (in FIG. 12, left side surface) of the hook 10, having a width W1 gradually decreasing from the base of the stem 11 to the tip of the hook-shape engaging portion 12. In the fifth and sixth embodiments, like the third and fourth embodiments, the strength of the hook 10 is increased remarkably and, at the same time, both the front part of the stem 11 and the inner part of the hook-shape engaging portion 12 are increased in rigidity as compared to the other part. Further, in the grooved region, when the loop moves on the hook 10 in the removing direction, opposite projections 10*d* of the U-shape groove 10*c* will deform as frictionally pressed by the loop so that the loop is difficult to disengage from the hook 10 due to the resiliency and frictional force of the opposite projections 10*d*, thus causing an increased force of engagement with a loop.

Figure 14:
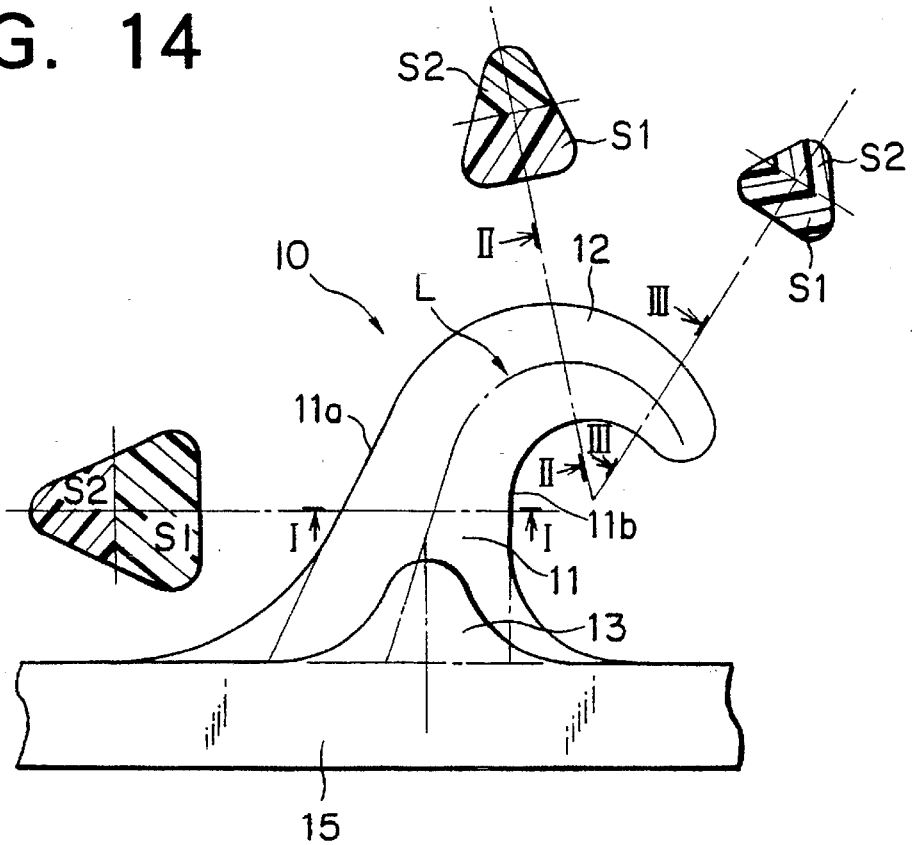
FIG. 14 is a side view of a hook according to a seventh embodiment tile invention, with transverse cross-sectional views taken along lines I—I, II—II and III—III, respectively.

FIGS. 14 shows a seventh embodiment, in which the transverse cross section of the hook 10 has a triangular shape. In the seventh embodiment, one of the three angles is situated on the rear side of the stem 11. With the seventh embodiment, like the foregoing embodiments, the strength of the hook 10 is increased remarkably, and at the same time, both the front part of the stem 11 and the inner part of the hook-shape engaging portion 12 are increased in rigidity as compared to the other part.

As is apparent from the foregoing description, according to the hook structure of this invention, in each of a transverse cross section of the stem along a line parallel to the substrate sheet and an arbitrary transverse cross section including a normal line at the lower surface of the hook-shape engaging portion, when the transverse cross-sectional area is divided into front and rear side cross-sectional areas, the front side cross-sectional area is set to be larger than the rear side cross-sectional area. Therefore, the neutral plane of the hook is shifted toward the front side of the stem and the inner side of the hook-shape engaging portion to a further extent than conventional to reduce possible tensile stresses in the front part of the stem and the inner part of the hook-shape engaging portion so that, as compared to the conventional hook made of the same resin quantity and having a substantially similar shape, the strength of the hook is increased remarkably and, necessarily, both the front part of the stem and the inner part of the hook-shape engaging portion have an increased degree of rigidity as compared to the other part and hence are difficult to deform, thus causing an increased force of engagement with a loop of the companion loop.

In the case that the transverse cross section of the hook has a generally criss-cross shape, a generally inverted T shape or a generally U shape, when the loop of the companion surface fastener is moved on the hook as pulled in the removing direction, the small-thickness part of the hook will resiliently deform as frictionally pressed by the loop so that the resiliency and frictional force simultaneously act between the hook and the loop to cause the loop become difficult to disengage from the hook, thus causing a further increased force of engagement with the loop.

What is claimed is:

1. A hook structure for a molded surface fastener comprising:

a substrate sheet; and a multiplicity of hooks molded on and projecting from one surface of said substrate sheet, each of said hooks is composed of a stem, which has a rear surface rising obliquely in a smooth curve from said substrate sheet and a front surface rising upwardly from said substrate sheet, and a hook-shape engaging portion extending forwardly from a distal end of said stem, said hook shape engaging portion having an upper surface and a lower surface, and wherein a first transverse cross section of said stem of each of said hooks in a plane taken parallel to the surface of said substrate sheet has a first cross-sectional area divided into front and rear side cross-sectional areas with rerspect to a transverse line located midway between said front and rear surfaces, said front side cross-sectional area is larger than said rear side cross-sectional area, and wherein a second transverse cross section of said hook-shape engaging portion of each of said hooks taken in a plane which is perpendicular to said lower surface has a second cross sectional area divided into upper and lower side cross-sectional areas with respect to a transverse line located midway between said upper and lower surfaces, said lower side cross-sectional area is larger than said upper side cross-sectional area.

2. A hook structure according to claim 1, wherein each of said first and second transverse cross sections has a generally trapezoidal shape.

3. A hook structure according to claim 1, wherein each of said first and second transverse cross sections has a shape analogous to the longitudinal cross section of an egg.

4. A hook structure according to claim 1, wherein each of said first and second transverse cross sections has a generally U shape.

5. A hook structure according to claim 1, wherein each of said first and second transverse cross sections has a generally inverted T shape.

6. A hook structure according to claim 1, wherein each of said first and second transverse cross sections has a generally criss-cross shape.

7. A hook structure according to claim 1, wherein each of said first and second transverse cross sections has a generally triangular shape.

8. A hook structure according to claim 1, wherein said second cross sectional area and said first cross sectional area are gradually increasing taken from a tip of said hook-shape engaging portion to a base of said stem.

9. A hook structure according to claim 1, wherein each of said hooks has a reinforcing rib on at least one side surface of said stem.

10. A hook structure for a molded surface fastener comprising:

a substrate sheet; and a multiplicity of hooks molded on and projecting from one surface of said substrate sheet, each of said hooks is composed of a stem, which has a rear surface rising from said substrate sheet and a front surface rising upwardly from said substrate sheet, and a hook-shape engaging portion extending forwardly from a distal end of said stem, said hook shape engaging portion having an upper surface and a lower surface, and wherein a first transverse cross section of said stem of each of said hooks taken in an arbitrary plane parallel to the surface of said substrate sheet has a first cross sectional area, and the first transverse cross section is shaped such that when said first cross sectional area is divided into front and rear side cross-sectional areas with respect to a transverse line located midway between said front and rear surfaces, said front side cross-sectional area is larger than said rear side cross-sectional area, and wherein a second transverse cross section of said hook-shape engaging portion of each of said hooks taken in an arbitrary plane which is perpendicular to said lower surface has a second transverse cross sectional area, and the second transverse cross section is shaped such that when said second cross sectional area is divided into upper and lower side cross-sectional areas with respect to a transverse line located midway between said upper and lower surfaces, said lower side cross-sectional area is larger than said upper side cross-sectional area.

11. A hook structure according to claim 10, wherein each of said first and second transverse cross sections has a generally trapezoidal shape.

12. A hook structure according to claim 10, wherein each of said first and second transverse cross sections has a shape analogous to the longitudinal cross section of an egg.

13. A hook structure according to claim 10, wherein each of said first and second transverse cross sections has a generally U shape.

14. A hook structure according to claim 10, wherein each of said first and second transverse cross sections has a generally inverted T shape.

15. A hook structure according to claim 10, wherein each of said first and second transverse cross sections has a generally criss-cross shape.

16. A hook structure according to claim 10, wherein each of said first and second transverse cross sections has a generally triangular shape.

17. A hook structure according to claim 10, wherein said second and first transverse cross sections are gradually increasing from a tip of said hook-shape engaging portion to a base of said stem.

18. A hook structure according to claim 10, wherein each of said hooks has a reinforcing rib on at least one side surface of said stem.

19. A hook structure according to claim 10, wherein said rear surface is a smooth obliquely rising surface from said substrate.

* * * * *